United States Patent [19]

Bevans et al.

[11] 4,432,531

[45] Feb. 21, 1984

[54] VEHICLE JACK

[76] Inventors: Terry D. Bevans; James L. Hammer, both of 6902 Manhattan Ln., Cheyenne, Wyo. 82001

[21] Appl. No.: 367,551

[22] Filed: Apr. 12, 1982

[51] Int. Cl.[3] ..... B66F 3/36

[52] U.S. Cl. ..... 254/100; 254/133 R; 254/DIG. 4

[58] Field of Search ..... 254/98, DIG. 4, 103, 254/100, 133, 94, 104; 144/193 D, 193 E; 294/87 R; 248/309.1, 68 R, 68 CB; 414/427

[56] References Cited

U.S. PATENT DOCUMENTS

| | | | |
|---|---|---|---|
| 189,854 | 4/1877 | Fulton | 254/98 |
| 1,475,864 | 11/1923 | Perry et al. | 254/133 R |
| 1,912,475 | 6/1933 | Countryman | 254/133 R |
| 2,396,241 | 3/1946 | Besler et al. | 248/68 R |
| 2,597,760 | 5/1952 | Strohm | 294/87 R |
| 3,808,788 | 5/1974 | Viglione | 294/87 R |
| 4,277,050 | 7/1981 | Mostert | 254/94 |
| 4,283,828 | 8/1981 | Cole | 254/100 |

*Primary Examiner*—Robert C. Watson

*Attorney, Agent, or Firm*—Wilbur A. E. Mitchell

[57] ABSTRACT

An operable vehicle jack for use between aligned peripheries of a pair of vehicle tandem wheels, and having a bell-like housing member associated with a raisable jack portion, whereby upon jack operational raising said housing becomes wedgedly held against and between said aligned tandem wheel peripheries.

2 Claims, 6 Drawing Figures

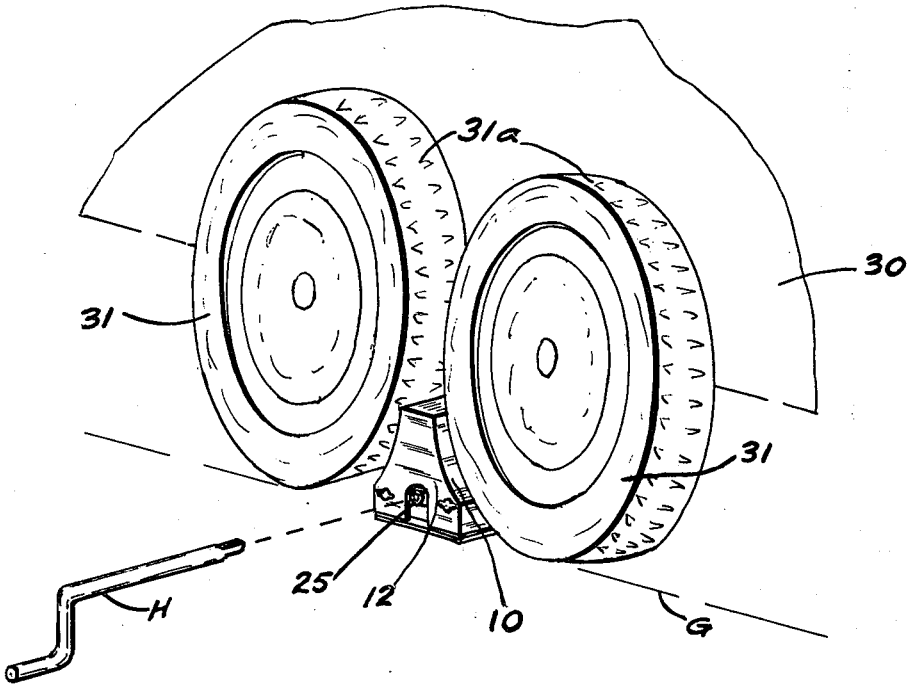
Fig. 4
Fig. 5
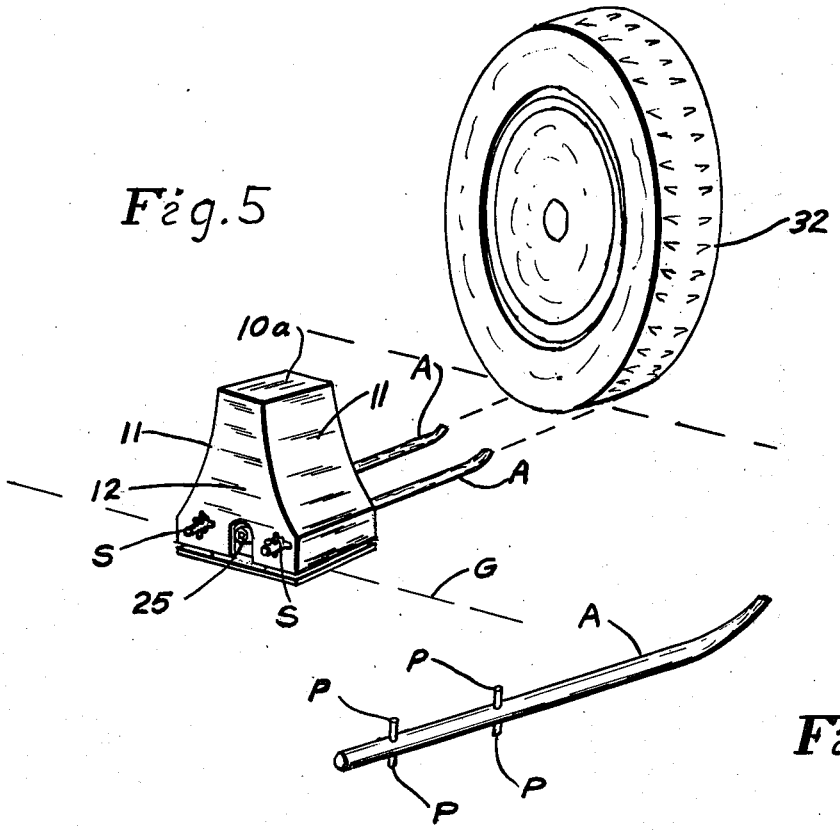
Fig. 6

VEHICLE JACK

BACKGROUND OF INVENTION

Recreational and other vehicles having one or more pairs of aligned tandem wheels have a problem, when there is need to raise the vehicle for any purpose, such as to park the vehicle for temporary or permanent elevated holding on blocks. There is a problem in the type of a jack or raising means adaptable for accomplishing such raising. Heretofore, as far as known, a jack lifting means is usually inserted under the vehicle axle or frame, and there has been no jack capable of insert use between a pair of its aligned tandem wheels. There is need for a wedge type jack adaptable to be inserted between the peripheries of aligned tandem wheels, for jack lifting torque to be applied directly to the aligned peripheries of the pair of tandem wheels. In the case of a vehicle having two pairs of aligned tandem wheels, and a tire of one wheel is required to be changed, as far as known, there has been no jack adaptable to raise those pairs of tandem wheels, by wedge jack insert between the peripheries of the aligned inflated tandem ones of the dual pair. Applicants have solved the problem by their novel wedge jack.

BRIEF DESCRIPTION OF INVENTION

Applicants have perfected a novel operable wedge jack having a hollow bell or cone-like shape raisable housing associated with the raisable part of our jack. The housing of our jack has substantially four sides, with an opposing pair of sides formed vertically arcuate inwardly or bell-shaped, and with two other sides formed as flat opposing vertical pair of sides. Within our housing we secure a manually operable or otherwise suitably operable, as by hydraulic power, conventional lifting jack, and with the jack having a suitable base secured thereunder. Upon operation of the jack, our housing secured thereto is raised with the jack raisable part so that the arcuate sides of the housing are adapted to press up against aligned tandem wheel peripheries. On use, our jack is inserted between a pair of aligned tandem wheels, and the jack operably raised to cause the housing to wedge between the periphery of said pair of tandem wheels and thus raise the wheels on jack operation. When occasion requires use of our jack to raise a single wheel, we provide detachable lifting arms removably inserted transversely of the lower portion of our housing, for insert of those arms under the single wheel and a lifting of the wheel by those arms on operation of the jack.

OBJECTS OF THE INVENTION

It is a principal object of our invention to provide an operable jack, having a bell-like arcuate diametrically opposing housing pair of lifting surfaces adapted to fit between a pair of aligned tandem wheels upon jack raising operation for a raising of those wheels on such operation.

Another principal object of our invention is to provide an operable jack having a hollow housing secured to its upper jack raising portion, and with the housing formed as a diametrically opposing pair of periphery shapes substantially corresponding to the periphery curve of a pair of aligned tandem wheels, whereby upon jack use between such wheels the housing will become wedged between said wheels for effecting a jack lifting of the wheels on jack operation.

Another object of our invention is to provide a vehicular wheel jack having a hollow cone-like or bell-like housing secured to the raisable part of the jack, with the jack having a rigid horizontal base plate secured thereto, and having a raisable shaft on jack operation secured within the housing, for effecting a raising of the housing on jack operation, and with the jack's outer housing surface being adapted for wedge abutment against aligned peripheries of a pair of tandem wheels.

Another object is to provide an operable vehicle jack adapted to fit between the peripheries of a pair of aligned tandem wheels, and with said jack having a housing having two different pairs of opposing sides, with one of said pairs being vertically opposingly straight and another pair being opposingly arcuate inwardly, and with one of said pairs having two pairs of aligned openings adjacent its lower edge portions, with each of said openings adapted to removably receive a single wheel lifting bar extending therethrough and therefrom.

DETAILED DESCRIPTION

Referring to the drawings, wherein like reference numbers and characters have been used to represent like or similar parts:

FIG. 4 is a reduced diagrammatic perspective showing our jack between a pair of tandem wheels of a recreational vehicle, before jack raising operation between those wheels being effected by the jack crank H.

FIG. 5 is a reduced diagrammatic perspective view, illustrating the use of our jack to raise a single wheel, after insert of a pair of lifting arms A with our jack.

FIG. 6 is a view of one of our lifting arms A, and which pair of arms are shown in FIG. 5.

Figure 1:
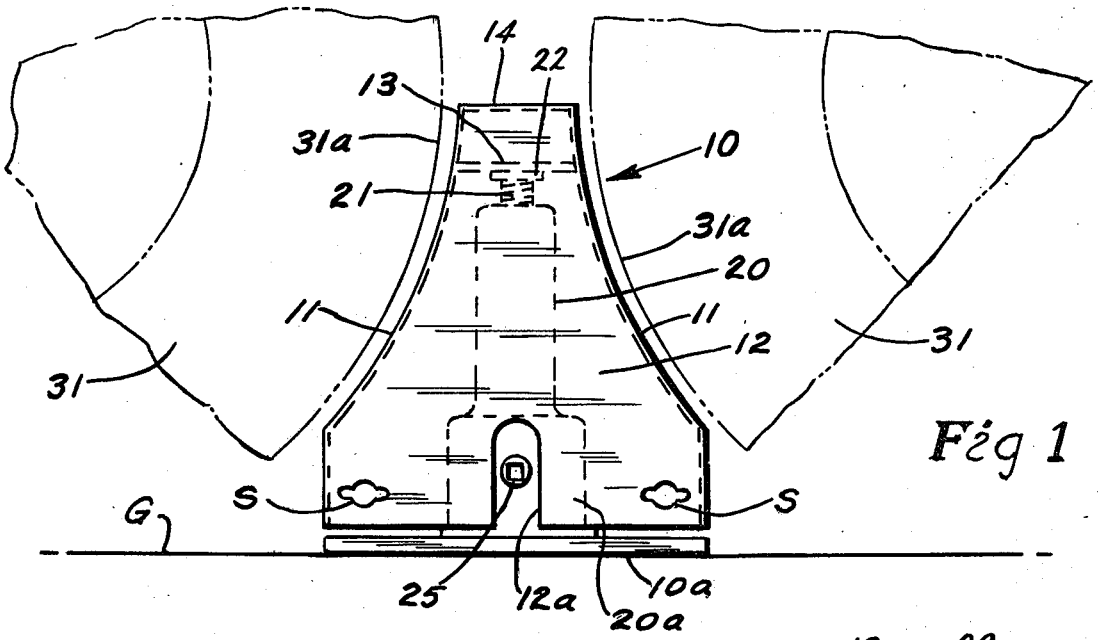
FIG. 1 is a side elevational view of our jack resting on the ground between a pair of aligned tandem wheels of a recreational vehicle, partially shown, and before jack operation.
Figure 2:
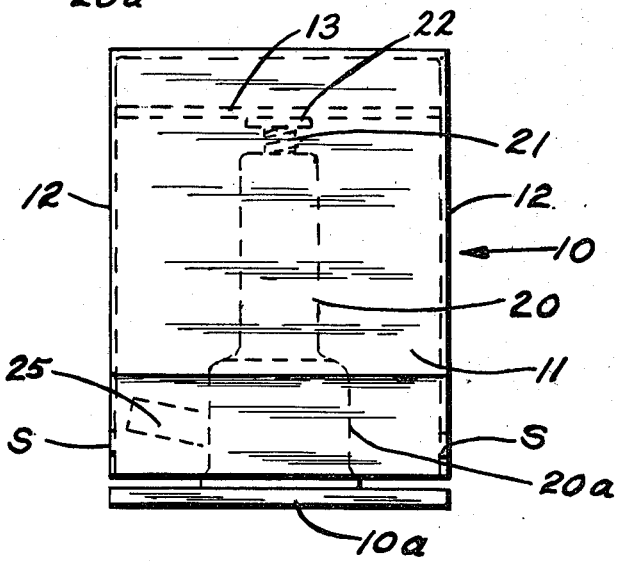
FIG. 2 is a side elevational view of our jack of FIG. 1, illustrative of its opposing flat vertical outer housing surfaces.
Figure 3:
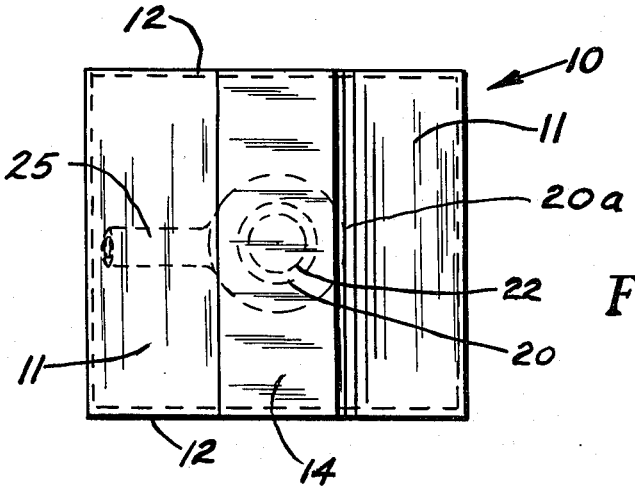
FIG. 3 is a view looking down upon our jack.

We diametrically partially show a recreational vehicular body 30, in FIG. 4, having a pair of front to back aligned tandem wheels 31 on one side of the vehicle. Referring to our novel jack, shown generally as 10, of FIG. 1, we provide an operable jack unit having a relatively large base plate 10*a* secured to the lower edge of our jack 20, and with a hollow bell or cone-like housing member generally indicated as 10. Our hollow housing 10 has substantially four vertical sides. Two opposing sides thereof are formed as inward arcuate curved opposing surfaces, shown at 11. Those curved surfaces 11 of the bell-like housing are adapted substantially to conform to the outer peripheries of an aligned pair of tandem wheels, when the jack is placed between those wheels, as will be explained during jack use. As shown in FIG. 3, looking down onto our jack, our housing 10 also has two other opposing sides indicated as 12, and they are vertically flat and straight and are parallel to each other. Within the hollow housing 10, we secure a rigid brace 13 cross-member, adjacent its upper inner apex, as indicated in FIG. 1. Our jack 20 is a conventional manually operable screw jack, and is secured to the floor base plate 10*a* as shown. Jack 20 has a vertically raisable worm gear conventional type shaft 21, which meshes with a conventional rotatable inner worm gear collar, operably provided in the jack base 20*a*, and which collar gear is conventionally rotatable to cause the jack shaft 21 to be raised and lowered thereby, upon conventional crank operation, as will be understood. While we show the jack as manually operable, it could be hydraulically operable. The jack raisable shaft 21 is fixedly secured to the cross-bar 13 at its top and within the housing 10, so that upon a raising or lowering of 21 the bell housing 10 secured to and carried by 13 will be raised and lowered therewith and thereby.

On operation, we place the jack so that its housing 10 will be in alignment between the peripheries of a pair of aligned tandem wheels 31, and with its base plate 10*a* resting on the ground, as shown in FIG. 1. Then the crank H is inserted into the socket 25, provided to operate the worm gears of the jack to raise the shaft 21, and by a manual cranking of that crank H thereby a raising or lowering of the jack shaft 21 is effected. Such a raising of 21, through the cross-bar 13 adjacent to the housing 10, causes our housing 10 to be raised, with and by 21, and thereupon the two outer opposing bell-like inner arcuate surfaces 11 of our jack 10 are wedgedly raised and pressed between and against the peripheries of said outer tandem wheels 31, as will be understood in viewing FIG. 1. FIG. 1 illustrates before the start of that raising operation. Such jack 10 operational raising causes a lifting of the tandem wheels 31, by the jack arcuate surfaces 11 friction wedge fitting and holding against rotating those wheels 31. In that friction fit holding of wheels 31 from rotating by jack 10, then upon such jack raising the raising torque of housing 10, is exerted through housing surfaces 11 against those wheels and a jack lifting of the vehicle by said tandem wheels is effected. During that jack 10 wedge lifting of the wheels 31, the wheels are prevented from rotating by the jack housing member 10 tightly fitting wedgedly between the peripheries of those aligned wheels and thus preventing those wheels revolving.

When it might not be possible to use our novel tandem wheel lifting jack, such as, for example, because of too great a distance between the peripheries of a pair of aligned vehicle tandem wheels, we provide a way to be able to use our jack for the lifting of one wheel, as shown in FIG. 5. We provide two pairs of aligned bayonet-like slot openings S, adjacent the lower housing edge opposed pair of walls 12. Then we use a pair of rigid straight lifting bars A, as shown in FIG. 6, each removably inserted through one pair of aligned openings S. Each bar A has two pairs of spaced apart rigid radially opposed aligned pins P, positioned and as shown in FIG. 6, from and secured to the bar peripheries. In using our jack, as shown in FIG. 5, we insert each rigid lifting bar A through a pair of opposing openings S, and, when so inserted, each A bar is then radially manually turned about 90° in its slots S, for purpose of causing pins P to hold the bar from accidental removal from its openings S upon jack lifting use, being a conventional bayonet slot method of removable bar attachment. In this modification, upon using our jack so to raise our one wheel 32, as shown in FIG. 5, with arms A inserted as shown, our jack 10 is placed on the horizontal ground surface G adjacent the wheel. The jack is then placed with its one straight side 12 closely adjacent that wheel, and the jack with its arms A extending laterally therefrom, so that said arms A are on the ground, and adjacent each underside of the wheel in close proximity to the depressed portion of the wheel resting on the ground, and the jack is then pushed towards the wheel 32 to place arms A under wheel 32, as diametrically illustrated in FIG. 5. In this use of our jack, as shown in FIG. 5, upon jack operation, by operating the crank H, as heretofore explained, a jack lifting of the shaft 21 occurs which thereby causes a lifting of the housing 10 by shaft 21. With such housing 10 lifting a lifting of said lifting arms A occurs and the wheel is then lifted by those arms A. Thus the arms A create a lifting of the wheel as the jack housing 10 is raised, on jack operation. On such lifting use of our jack, the one flat side 12 of the jack housing adjacent the wheel thus substantially abuts flush against the adjacent outside of that wheel being raised as the lifting occurs by the arms A. In such jack lifting use, the weight of the vehicle being raised on the raising of that wheel rests mainly on said lifting pair of arms A, and also, on such jack lifting, the outside surface of the wheel 32 abuts against the adjacent flat side 12 of the jack, and said jack abutment against the wheel prevents a tipping of the base 10*a* of the jack, on said single wheel raising by said jack lifting arms A.

Many changes and modifications can be made within the spirit, intent and teaching of our invention, as hereinbefore, such as our housing portion 10 of our jack may be constructed as a solid member, instead of hollow as heretofore explained, and the housing can be removably associated with the jack, instead of secured thereto. Also, the outer wedge-shape configuration of our housing may be of any one of several different shapes or designs, with each adapted for friction fit substantial conformance with the outer periphery of the aligned adjacent tandem wheels, as the jack is used therebetween aligned pair of tandem wheels. Further, the housing portion 10 of our jack may be made wider to abut against peripheries of two aligned pairs of tandem wheels, when used to raise a vehicle having two pairs of tandem wheels on each side.

Therefore, it is to be understood that we wish to be bound only by the hereunto appended claims.

What we claim and desire to secure by Letters Patent is:

1. An operably raisable jack for lifting a vehicle having a pair of aligned tandem wheels by the pair of aligned tandem wheels comprising, in combination, a manually vertically operable jack having a transverse base plate and a raisable shaft portion, a bell-shaped housing extending around the jack and removably secured to the top of the raisable jack shaft, said housing having four sides, with two of said sides being diametrically opposed and formed as inward arcuate vertical surfaces, and the other two of the housing sides being diametrically formed as opposing flat vertical surfaces, said arcuate opposed surface sides being adapted to frictionally wedge abut the outer periphery of a pair of aligned tandem wheels upon jack operation between such pair of aligned wheels for effecting jack vehicle raising by said wheels, and said housing flat opposed surface sides each having aligned bayonet-slot openings adjacent their lower edges and with each opening being adapted to removably receive and hold a transverse wheel lifting bar therein.

2. An operably raisable jack for lifting a vehicle having aligned tandem wheels by its said wheels, comprising, in combination, a manually vertically operable jack having a transverse base plate and a raisable shaft portion thereon, means for operably raising the shaft portion, a bell-shaped housing removably secured to the raisable shaft and with the housing extending completely around the shaft, said housing having four outer sides and with two of said sides being formed as diametrically opposed arcuate surfaces, said arcuate opposed housing surfaces being adapted to frictionally wedgedly abut the outer peripheries of aligned tandem wheels upon jack raisable operation between said wheels.

* * * * *